US008082850B2

(12) United States Patent
Marx

(10) Patent No.: US 8,082,850 B2
(45) **Date of Patent: *Dec. 27, 2011**

(54) SYNCHRONIZED SPIN MULTI-COMPONENT PROJECTILE

(75) Inventor: PJ Marx, Sarasota, FL (US)

(73) Assignee: Liberty Ammunition, Inc., Clearwater, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/784,654

(22) Filed: May 21, 2010

(65) Prior Publication Data

US 2011/0155016 A1 Jun. 30, 2011

Related U.S. Application Data

(63) Continuation-in-part of application No. 11/255,261, filed on Oct. 21, 2005, now Pat. No. 7,748,325.

(60) Provisional application No. 61/326,827, filed on Apr. 22, 2010.

(51) Int. Cl.
*F42B 14/02* (2006.01)
*F42B 30/02* (2006.01)

(52) U.S. Cl. ..... 102/517; 102/524; 102/501

(58) Field of Classification Search ..... 102/524, 102/525, 526, 527, 501, 506, 512, 513, 517
See application file for complete search history.

(56) References Cited

U.S. PATENT DOCUMENTS

| | | | |
|---|---|---|---|
| 29,272 | A | 7/1860 | Hotchkiss |
| RE1,247 | E | 12/1861 | Hotchkiss |
| 443,101 | A | 12/1890 | Maxim |
| 2,120,913 | A | 6/1938 | Studler |
| 2,922,341 | A | 1/1960 | Treat, Jr. |
| 3,003,420 | A | 10/1961 | Nosler |
| 3,063,376 | A | 11/1962 | Powell |
| 3,142,256 | A | 7/1964 | Mack |
| 3,282,214 | A | 11/1966 | Briscoe |
| 3,616,758 | A | 11/1971 | Komarov |
| 3,713,386 | A | 1/1973 | Zaid |
| 3,939,773 | A | 2/1976 | Jenkins et al. |
| 3,948,263 | A | 4/1976 | Drake, Jr. et al. |
| 4,431,150 | A | 2/1984 | Epperson, Jr. |
| 4,836,108 | A | 6/1989 | Kegel et al. |

(Continued)

OTHER PUBLICATIONS

International Search Report for PCT application No. PCT/US2011/028106 with a date of mailing of May 5, 2011.

(Continued)

*Primary Examiner* — James Bergin
(74) *Attorney, Agent, or Firm* — Anton J. Hopen; Smith & Hopen, P.A.

(57) ABSTRACT

A projectile includes a leading part formed by a tip and a tip base that form a first annular shoulder where they meet. A trailing part of the projectile is formed by a base having a frusto-conical trailing end and a cylindrical leading end of truncate extent that forms a tail drive. A second annular shoulder is formed where a cylindrical rod meets the tail drive. A flat trailing end of the tip base and a flat leading end of the cylindrical rod abut one another when the projectile is assembled. A cylindrical interface has a leading extent abutting the first annular shoulder and a trailing end abutting the second annular shoulder. The tail drive and the trailing extent of the cylindrical interface are the only parts of the projectile that engage gun barrel rifling when the projectile is positioned in a gun barrel.

3 Claims, 4 Drawing Sheets

U.S. PATENT DOCUMENTS

| | | | | |
|---|---|---|---|---|
| 4,884,508 | A | 12/1989 | Kruse et al. | |
| 4,939,996 | A | 7/1990 | Dinkha et al. | |
| 5,097,767 | A | 3/1992 | Cirillo | |
| 5,388,524 | A | 2/1995 | Strandli et al. | |
| 6,085,630 | A | 7/2000 | Manis | |
| 6,439,125 | B1 | 8/2002 | Carter | |
| 6,817,299 | B1 | 11/2004 | Cooke | |
| 7,900,561 | B2 * | 3/2011 | Marx | 102/526 |
| 2007/0089629 | A1 | 4/2007 | Marx | |

OTHER PUBLICATIONS

International Preliminary Report on Patentability for International Patent Application No. PCT/US2011/028106 dated May 5, 2011.

* cited by examiner

SYNCHRONIZED SPIN MULTI-COMPONENT PROJECTILE

CROSS-REFERENCE TO RELATED APPLICATIONS

This application is a continuation-in-part of and claims priority to U.S. application Ser. No. 11/255,261, entitled: "Firearms Projectile," filed Oct. 21, 2005 by the same inventor, which application is hereby incorporated by reference into this application. This application also claims priority to U.S. Provisional Patent Application Ser. No. 61/326,827 filed Apr. 22, 2010, which application is hereby incorporated by reference into this application.

BACKGROUND OF THE INVENTION

1. Field of the Invention

This invention relates, generally, to the art of projectiles. More particularly, it relates to a multi-component projectile having components that spin at a common rate as if the projectile were formed of a single component.

2. Description of the Prior Art

The components of a multi-component projectile may spin at independent rates as the projectile spins. Many factors may be involved including the fact that the different components may be made of different materials having different densities. This affects the inertia of each component and may result in differing components spinning in flight at different rates. Another important factor may be that the bonds between the various components may have differing strengths. The fact of non-synchronized spin is a problem, regardless of what causes it.

However, in view of the art considered as a whole at the time the present invention was made, it was not obvious to those of ordinary skill in the art how the limitations of the art could be overcome.

SUMMARY OF THE INVENTION

The long-standing but heretofore unfulfilled need for a multi-component projectile having a synchronized spin is now met by a new, useful, and non-obvious invention.

The novel projectile includes a leading part formed by a tip having an ogive configuration. A tip base is formed integrally with the tip. The tip base is substantially cylindrical but has a slight diameter-reducing taper formed in its leading extent where the tip base meets a trailing end of the tip. A first annular shoulder is formed where the trailing end of the tip meets a leading end of the tip base.

A trailing part of the projectile is formed by a base having a frusto-conical trailing end and an annular cylindrical leading end of truncate longitudinal extent that is formed integrally with the frusto-conical trailing end. For convenience, the annular cylindrical leading end of truncate longitudinal extent is hereinafter referred to as the tail drive. A cylindrical rod is formed integrally with the tail drive and extends therefrom in leading relation thereto. The cylindrical rod has a diameter less than the diameter of the tail drive, forming a second annular shoulder where a leading end of the tail drive meets a trailing end of the cylindrical rod.

The tip base has a flat trailing end and the cylindrical rod has a flat leading end. The flat trailing end of the tip base and the flat leading end of the cylindrical rod abuttingly engage one another when the projectile is in an assembled configuration.

A cylindrical interface has a leading extent disposed in overlying, i.e., ensleeving relation to the tip base and has a leading end disposed in abutting relation to the first annular shoulder. Moreover, the leading end of the cylindrical interface is flush with the trailing end of the tip when the projectile is fully assembled, i.e., after a crimping operation has been performed. A trailing end of the cylindrical interface is disposed in abutting, flush relation to the second annular shoulder.

About one-half to one-third of the extent of the cylindrical interface at its leading end and the frusto-conical trailing end of the base are spaced apart from gun barrel rifling when the projectile is positioned in a gun barrel.

Therefore, the tail drive and about one-half to two-thirds of the length of the cylindrical interface, including its middle and trailing extents, are the only parts of the projectile disposed in engaged relation to rifling when the projectile is disposed in a gun barrel. Accordingly, friction between the projectile and the rifling is reduced vis a vis a conventional projectile so that the novel projectile has increased kinetic energy when fired vis a vis a conventional projectile.

Spin imparted by the rifling that engages the tail drive and the trailing one-half to two-thirds of the cylindrical interface is not substantially degraded by the loss of contact with the rifling.

An important object of the invention is to provide a multi-component projectile where all components spin conjointly, i.e., in synchronization with one another.

Another important object is to provide such a projectile that has reduced frictional engagement with rifling in a gun barrel to increase its kinetic energy when fired without substantially degrading the spin imparted by the rifling.

Still another important object of the invention is that the juncture of the head and tail portions meet at a point wherein inward axial force imparted by the rifling lands effectively crimp the interface to the head and tail portions to maintain each portion in synchronized rotation.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
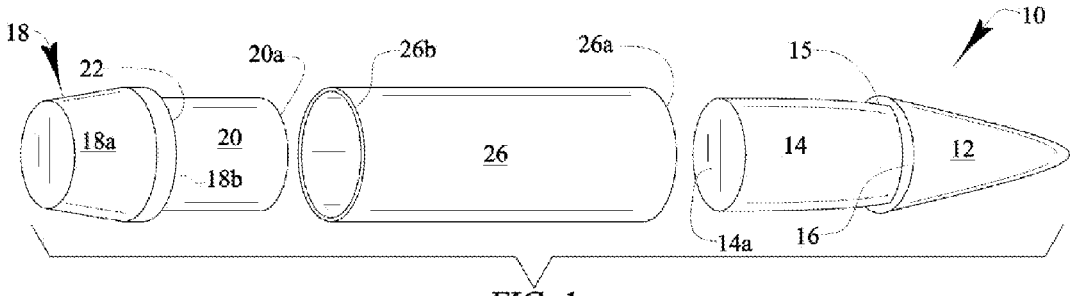
FIG. 1 is an exploded perspective view of the novel projectile.

Referring now to FIG. 1, it will there be seen that a diagrammatic representation of the novel projectile is denoted as a whole by the reference numeral 10.

Novel projectile 10 includes a leading part formed by nose cone or ogive-shaped tip 12 and tip base 14 formed integrally with said tip. Tip base 14 is substantially cylindrical but a slight diameter-reducing taper 15 is formed in its leading extent where the leading end of tip base 14 meets the trailing end of tip 12. If tip base 14 were cylindrical with no taper, it would have a diameter less than the diameter of the trailing end of tip 14. However, with slight downward taper 15 formed in the leading extent of tip base 14, the difference in diameter is a little larger. The diameter difference creates first annular shoulder 16.

Figure 2:
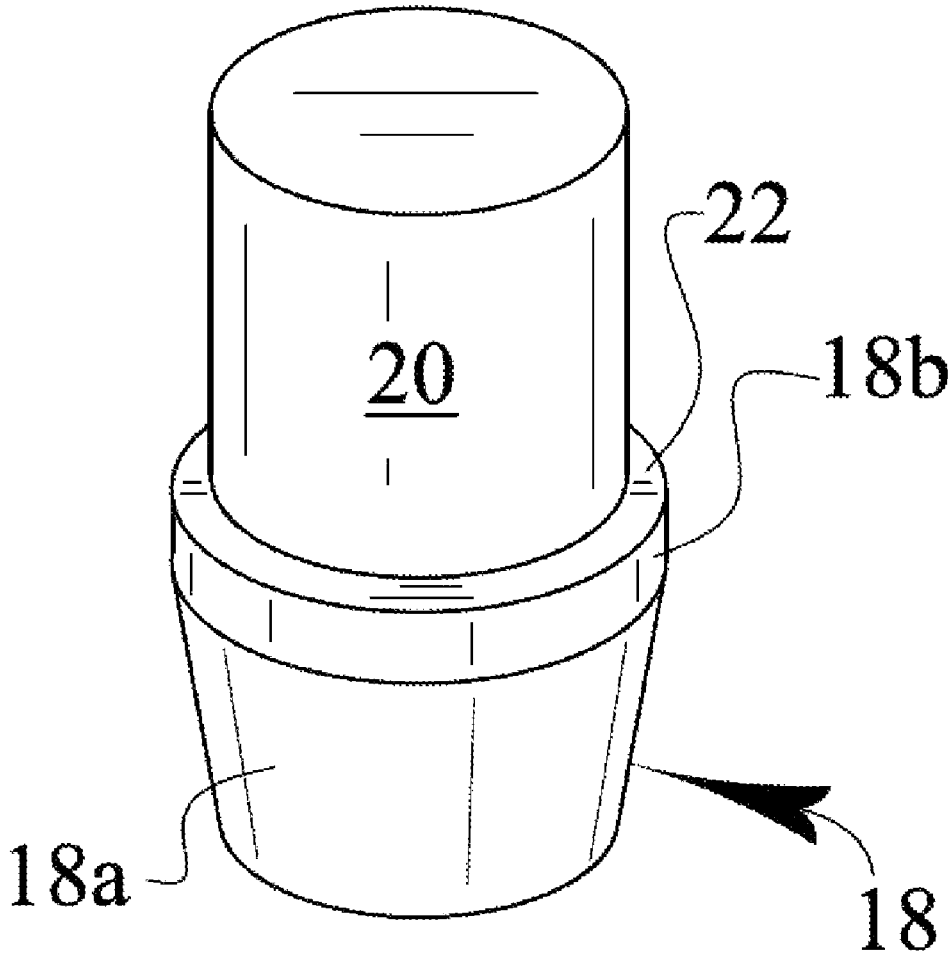
FIG. 2 is a perspective view of the trailing end of the projectile.

Novel projectile 10 further includes a trailing part formed by base 18 having a frusto-conical trailing end 18*a* and tail drive 18*b*. Cylindrical rod 20 is formed integrally with tail drive 18*b*. As perhaps best depicted in FIG. 2, the trailing end of cylindrical rod 20 has a diameter less than the leading end of tail drive 18*b*, forming second annular shoulder 22.

Trailing end 14*a* of tip base 14 is flat as depicted in FIG. 1 as is the leading end 20*a* of cylindrical rod 20. Flat surfaces 14*a* and 20*a* abuttingly engage one another along parting line 24 when projectile 10 is substantially assembled as depicted in FIG. 3.

Figure 3:
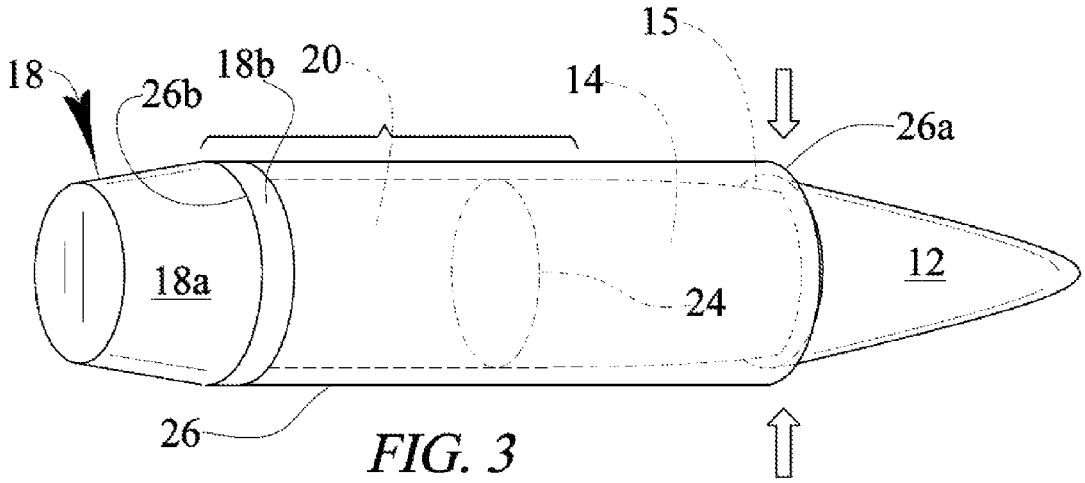
FIG. 3 is a perspective view of the novel projectile when substantially assembled but prior to a crimping step that completes the assembly.

As shown in FIG. 3, the juncture 24 of the tip 12 and base 18 portions meet at a point wherein inward axial force imparted by the rifling lands effectively crimp the interface 26 to the tip 12 and base 18 to maintain each portion in synchronized rotation. In a preferred embodiment of the invention, juncture 24 is located at a longitudinal midpoint of interface 26.

Figure 4:
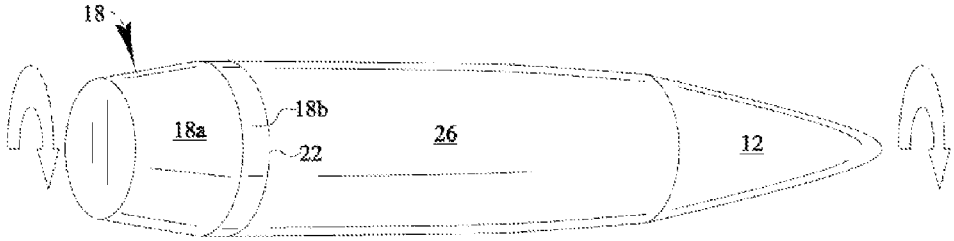
FIG. 4 is a perspective view of the novel projectile after the crimping step has been performed to complete the assembly.

FIG. 3 also depicts cylindrical interface 26 when it is inserted over tip 12 so that its trailing end 26*b* abuts second annular shoulder 22. Leading end 26*a* of said cylindrical interface is then crimped as indicated by the radially inwardly directed arrows in FIG. 3 so that the leading end of cylindrical interface 26 is flush with the trailing end of tip 12 when projectile 10 is fully assembled as depicted in FIG. 4. The crimping action also conforms the leading extent of cylindrical interface 26 to the downward taper of the leading extent of tip base 14.

Rotational arrows in FIG. 4 indicate a rotational spin of projectile 10 about its longitudinal axis of symmetry which is also it axis of rotation during flight. All of the components are centered on said axis of rotation.

Figure 5:
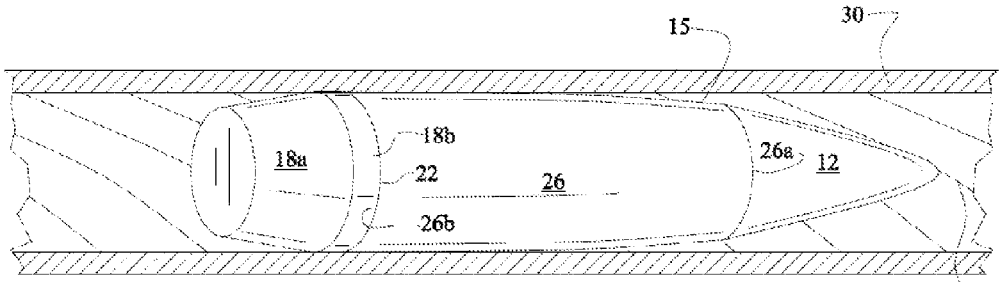
FIG. 5 is a perspective view depicting the novel projectile when positioned in a gun barrel that is cut-away.

FIG. 5 indicates the significance of taper 15. When fully crimped, leading end 26*a* of cylindrical interface 26 conforms to the downwardly tapered contour 15 of tip base 14 as aforesaid so that leading end 26*a* and the leading one-half to one-third extent of cylindrical interface 26 are spaced apart from rifling 28 formed in barrel 30. The leading extent of cylindrical interface 26 extends about one-half to one-third of the total length of said cylindrical interface.

FIG. 5 also indicates the significance of the frusto-conical shape of base trailing end 18*a*. Only tail drive 18*b* engages rifling 28.

Similarly, the leading extent of cylindrical interface 26 is tapered downwardly in diameter as aforesaid and as depicted in FIG. 5 so that only the middle and trailing extents of cylindrical interface 26 engage said rifling.

Thus, only tail drive 18*b* and about the trailing one-half to two-thirds of the length of cylindrical interface 26 engage rifling 28. This lowers the friction encountered by projectile 10 while in the hollow interior of barrel 30 so that its kinetic energy is increased when fired, vis a vis a conventional projectile. Significantly, however, the spin imparted by rifling 28 along tail drive 18*b* and along the trailing one-half to two-thirds of cylindrical interface 26 is not substantially degraded by the loss of contact with rifling 28.

Projectile 10 is said to have a direct tail drive because the only parts of the projectile that contact the rifling are tail drive 18*b* and the trailing one-half to two-thirds of cylindrical interface 26.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A projectile, comprising:

a leading part formed by a tip having an ogive configuration;

a tip base formed integrally with said tip, said tip base being substantially cylindrical but having a slight diameter-reducing taper formed in its leading extent where said tip base meets a trailing end of said tip;

a first annular shoulder formed where said trailing end of said tip meets a leading end of said tip base;

a trailing part formed by a base that includes a frusto-conical trailing end and a tail drive formed by an annular cylindrical leading end of truncate extent that is formed integrally with said frusto-conical base;

a cylindrical interface connecting said leading part to said trailing part;

a cylindrical rod formed integrally with said tail drive and extending therefrom in leading relation thereto;

said cylindrical rod having a diameter less than the diameter of said tail drive; and a second annular shoulder formed where a leading end of said tail drive meets a trailing end of said cylindrical rod.

2. The projectile of claim 1, further comprising:

said tip base having a flat trailing end;

said cylindrical rod having a flat leading end;

said flat trailing end of said tip base and said flat leading end of said cylindrical rod abuttingly engaging one another when said projectile is in an assembled configuration.

3. The projectile of claim 2, further comprising:

said cylindrical interface having a downwardly tapered leading extent disposed in overlying relation to said downwardly tapered tip base;

said cylindrical interface having an untapered middle extent and trailing extent;

a leading end of said cylindrical interface disposed in abutting relation to said first annular shoulder;

said leading end of said cylindrical interface being flush with said trailing end of said tip;

a trailing end of said cylindrical interface disposed in abutting relation to said second annular shoulder;

said downwardly tapered leading extent of said cylindrical interface being spaced apart from rifling when said projectile is positioned in a gun barrel;

said frusto-conical trailing end of said base being disposed in spaced apart relation to said rifling when said projectile is positioned in said gun barrel;

said tail drive being disposed in engaged relation to said rifling when said projectile is disposed in said gun barrel;

said middle and trailing extents of said cylindrical interface being disposed in engaged relation to said rifling when said projectile is disposed in said gun barrel;

whereby friction between said projectile and said rifling is reduced vis a vis a conventional projectile so that said projectile has increased kinetic energy when fired vis a vis said conventional projectile; and whereby spin imparted by said rifling along said tail drive and along said middle and trailing extents of said cylindrical interface is not substantially degraded by the loss of contact with said rifling.

* * * * *